US005161339A

United States Patent [19]

Penczak

[11] Patent Number: 5,161,339

[45] Date of Patent: Nov. 10, 1992

[54] TILE/CARPET TRIM FOR TRENCH DUCT

[76] Inventor: John P. Penczak, 61 Karen La., Williamstown, W. Va. 26187

[21] Appl. No.: 680,644

[22] Filed: Apr. 2, 1991

Related U.S. Application Data

[63] Continuation of Ser. No. 569,965, Aug. 20, 1990, abandoned, which is a continuation of Ser. No. 420,885, Oct. 13, 1989, abandoned.

[51] Int. Cl.[5] ..... E04B 5/48

[52] U.S. Cl. ..... 52/221; 52/714

[58] Field of Search ..... 52/221, 220, 716, 126.2

[56] References Cited

U.S. PATENT DOCUMENTS

| | | | |
|---|---|---|---|
| 3,435,568 | 4/1969 | Hoseason | 52/126.2 |
| 3,593,472 | 7/1971 | Bargar | 52/126.2 |
| 4,319,438 | 3/1982 | Mikajiri | 52/221 |
| 4,478,897 | 10/1984 | Akashi | 52/716 |
| 4,612,746 | 9/1986 | Higgins | 52/126.2 |
| 4,637,185 | 1/1987 | Bowman | 52/221 |
| 4,899,506 | 2/1990 | Chapman | 52/221 |

*Primary Examiner*—John E. Murtagh

*Attorney, Agent, or Firm*—McAndrews, Held & Malloy, Ltd.

[57] ABSTRACT

Trim piece for trench duct which can be used where the floor covering is tile or carpet. There are three outwardly extending flanges. In the tile mode, one flange is used as a tile separator and the other flanges are used respectively to support the trench cover and an edge of the floor tile. In the carpet mode, the trim is turned 180° so the tile separator flange is inactive wile the other flange respectively support the edge of the floor tile and the trench cover. In the tile mode, the edge of the floor tile has vertical support so the breakage is avoided. This is attained by that the trim flange supporting the edge is in turn supported by the trench and by concrete.

4 Claims, 1 Drawing Sheet

TILE/CARPET TRIM FOR TRENCH DUCT

This application is a continuation of application Ser. No. 07/569,965, filed Aug. 20, 1990, now abandoned, which is a continuation of copending application Ser. No. 420,885 filed Oct. 13, 1989 now abandoned.

This invention relates in general to electrical underfloor or infloor power and communication systems for office buildings and the like and particularly relates to trenchduct supported or a metal or concrete subfloor.

More specifically the invention provides improvements in trim and side rail structure which can he employed in the trenchduct where the floor covering or tile or carpet.

The principal object of the invention is to provide trim and side rail structure which minimizes or eliminates cracking of the edge of floor tile adjacent the trench. This is accomplished by trim and rail structure which provides positive, underside support throughout the entire edge area of the tile.

The invention will be described below in connection will the following drawings wherein.

Figure 1:
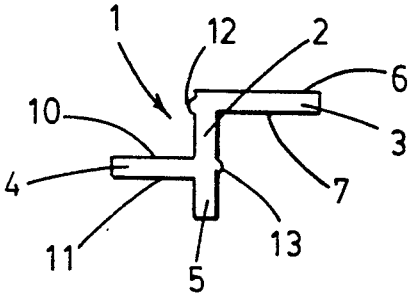
FIG. 1 is and end view of a tile/carpet trim piece oriented for use when the floor covering is carpet.

It will be understood that the terms of art "trenchduct" and "trench" used herein are synonymous.

Trenchduct is conventionally a constructed in three forms; i.e. full bottom, intermittent bottom, and bottomless. In all types the trench assembly includes a pair of side rails and covers and tile and/or trim supported by the rails. It is conventional, that a side rail upper and lower section with the upper section being vertically adjustable with respect to the lower section. The trim and side rails are elongated depending upon the desired length of the trench unit. In any event the invention is applicable to all trench employing side rails and trim. Thus, the drawing herein disclosed the invention by way of fragmentary end views.

The side rail herein is described in detail in my copending application Ser. No. 420,950 entitled IMPROVED SIDE RAIL FOR TRENCHDUCT and incorporated herein by reference.

Referring to FIG. 1, the trim piece 1 is an elongated body having: a center section 2; a rectangular shaped, solid carpet and cover support flange 3 extending outwardly from the center section 2; a rectangular shaped, solid tile and cover support flange 4 extending outwardly from the center section 2 in a direction opposite to the flange 3 and parallel thereto; and a rectangular shaped, solid tile edge separator flange 5 extending outwardly from the center section 2. The flanges 3 and 4 are both oriented to be normal to the flange 5.

The carpet and cover support flange 3 is formed with a pair of support surfaces 6 and 7. The tile and cover support flange 4 is formed with a pair of support surface 10 and 11. As will presently appear, these support surfaces are adapted to engage the side rails of the trench.

The support surfaces 6, 7, 10 and 11 are oriented to be generally parallel to one another.

The carpet and cover support flange 3 has a bead 12 and the title edge separator flange 5 has a bead 13. As will be more apparent later, the beads 12 and 13 serve to prevent the respective edges of the cover and the trim from being fictionally locked together. Thus the covers can be removed with out the necessity of removing the trim.

Figure 4:
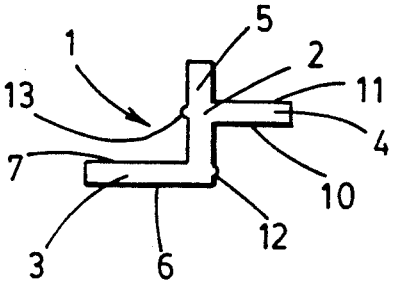
FIG. 4 is an end view of a tile/carpet trim piece oriented for use when the floor covering is tile.

Before proceeding, the respective orientations of the trim pieces in FIG. 1 and 4 should be noted. That trim piece in FIG. 1 in the carpet position. In FIG. 4, the trim is in the tile position. This is attained by rotating the trim (around it's axis) 180° from the carpet position of FIG. 1.

Figure 2:
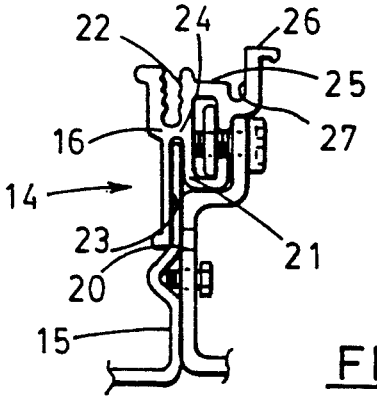
FIG. 2 is an end view of a side rail on which the trim of FIG. 1 is to be mounted, the side rail being on a full bottom trench.

Now referring to FIG. 2. I will now briefly describe a trench side rail of the kind shown in my copending application Ser. No. 420,950 and entitled IMPROVED SIDE RAIL FOR TRENCHDUCT.

The rail 14 comprises an upright lower section 15 and an upper section 16 which is slidable mounted on the lower rail so as to be vertically adjustable thereon.

The lower section 15 may be the upright exterior of a pan forming the bottom of a full bottom or intermediate bottom trench or may have an outwardly extending foot adapting the same to be mounted on the crest of a deck for a bottomless trench.

The upper section 16 has a vertically extending inside wall 20 and a vertically extending outside wall 21 which respectively form the upper channel 22 and lower channel 23. The lower section 15 is received in the lower channel 23 and the upper channel 22 receives cover holdown screws as will be noted later.

A support section generally indicated in 24 is connected to the outside wall 21 and extends outwardly therefrom. The support section 24 forms a lower trim support 25 and upper trim support 26 which is spaced upwardly and outwardly of the support 25. The support 24 also forms the trim cavity 27 between the trim supports 25 and 26. Note that the upper trim support 26 extends horizontally outwardly.

The further details on the structure side rail by reference may be had to my corresponding application Ser. No. 420,950.

The manner in which the trim piece 1 and side rail 14 are combined into an assembly adapting the trench for use with carpet floor covering and for use with tile floor covering will now be described in connection with FIGS. 3 and 5.

Figure 3:
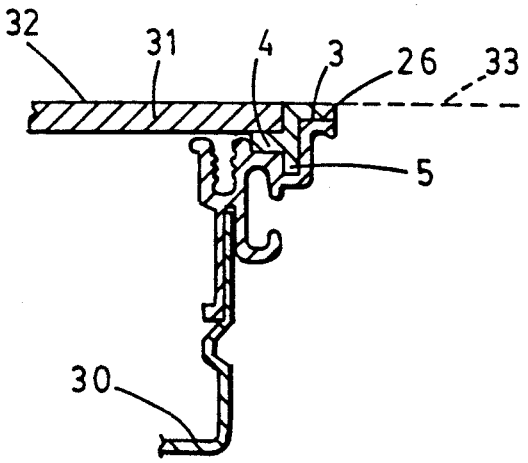
FIG. 3 is an end view of a trench assembly set up for use with carpet as the floor covering, the trench being full bottom.

In FIG. 3 the trench is the full bottom type with the bottom being indicated at 30.

The trim piece 1 is mounted on the support section 24 as follows. The surface 11 of tile and cover support flange 4 is mounted on lower trim support 25, the lower surface 7 of carpet and cover support flange 3 is mounted on the upper trim support 26. The tile edge separator flange 5 extends down unto the trim cavity 27.

A cover 31 is mounted on the surface 10 of the tile and cover support flange 4. The edge of the cover abuts the bead 12 (not shown in FIG. 3). The cover is held in position by holddown screws (not shown) extending thru the cover threaded into the upper channel 22. Note that the surface 6 of the flange 3 is flush with the surface 32 of the cover 31 and also flush with the concrete floor level 33.

With carpet floor covering over trenchduct it is conventional to separate the carpet on the trench covers from the carpet on the floor. Thus, in the arrangement of FIG. 3 the separation will occur along the same edge of the flange 3. The edge of the flooring carpet is supported on surface of flange 3.

With respect to screeding, the trench is mounted as in FIG. 3 and trim and cover provided with temporary paper or tape covering. The concrete is worked so; in that the surface 33 is co-planar with surface 6.

Figure 5:
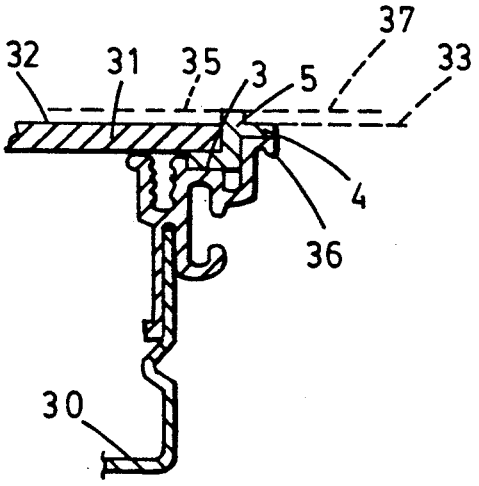
FIG. 5 is an end view of a trench assembly set up for use with tile as the floor covering.

In FIG. 5 the trench of FIG. 4 had arranged for use where the floor covering is tile.

The trim piece 1 has been rotated 180° about it's axis. The surface 10 of the tile and cover support flange 4 is now mounted on the upper trim support 26.

The surface 6 of the carpet cover support flange 3 is now mounted in the lower trim support 25. The cover 31 is mounted on the surface 7 of the carpet cover support flange 3 with the bead 13 (not shown) engaging the edge of the cover. The tile edge separator flange 5 extends upwardly away from the surface of the cover 31. The surface 11 of the tile and cover support the flange 4 is flush with the floor surface 33 and co-planar with the cover surface 32. The flange 5 extends upwardly from surfaces 11 and 31 to an extent commensurate with the tile thickness.

During the pour, the trench is set up as in FIG. 3 and the concrete screeded to the level of the trim surface 6. For tile installation the covers are removed and then the trim is removed and rotated 180° and replaced as in FIG. 6. The covers are then reinstalled and the set up is ready for tile. The tile on the cover is indicated by dotted lines 35.

With reference to FIG. 5 it will be observed that the outwardly extending upper trim support 26 is supported by the concrete as noted at 36 and that the edge of the floor tile 37 is supported on surface 11 of the tile and cover support flange 4. Thus, there in no open space under the edge of the floor tile which otherwise would result in cracking. The trim piece is extruded so that it has a dualdurometer characteristic so that the part of the trim which engage the aluminum extrusion are relatively soft. This enhances sealing and load absorption, the latter effecting longer trim life. An example of the above is 70 durometer for the surface 5,6,7,10 and 11 and 78 durometer for the remainder of the trim is.

Before closing, it is pointed out that certain installations require that the trim piece be made of extruded aluminum rather than plastic. In such cases the thickness of each of the flanges 3 and 4 is reduced and a conventional sealing strip is employed between the trim and the aluminum upper section.

While I have illustrated the trim as employed on a full bottom trench, it will be readily apparent the trim is to be employed on side rails for bottomless trench.

I claim:

1. In a poured concrete floor having trench duct therein with the concrete floor having a generally horizontal upper surface adapted to be covered by selectively one of a carpet and a plurality of tiles of a predetermined tile thickness, and with each trench duct including: a pair of spaced apart side walls which are disposed so that their upper ends are near to the upper surface of the concrete floor and so that the side walls are in generally vertical, parallel planes, and which define therebetween a trench in the concrete floor and below the upper surface of the concrete floor, which trench terminates upwardly as a horizontal opening in the upper surface of the concrete floor; and a removable trench duct cover having an upper surface, a uniform thickness, and a width slightly greater than the distance between the vertical planes of the trench duct side walls, with the trench duct cover being adapted to close the horizontal opening defined by the trench duct side walls, the improvement comprising:

a plurality of elongated side rails, with a side rail being mounted on the upper end of each of the trench duct side walls and with each side rail including:

a trench duct cover support flange having an upper surface, a first end, and a second end, and being disposed, with respect to the vertical plane of the trench duct side wall, so that it extends horizontally outwardly with respect to the trench, from the first end to the second end, so that has its upper surface is below the plane of the upper surface of the concrete floor a distance substantially equal to the thickness of the trench duct cover plus a first predetermined distance, and so that its upper surface may support the side edge of the trench cover when the trench cover closes the horizontal opening of the trench; and a trim support flange having an upper surface, a first end, and a second end, and being disposed, with respect to the vertical plane of the trench duct side wall, so that it extends outwardly, with respect to the trench, from the first end to the second end, so that its first end is farther from the vertical plane of the trench duct side wall than either of the first and second ends of the cover support flange, and so that its upper surface is below the plane of the upper surface of the concrete floor a second predetermined distance; with the cover support flange and the trim support flange be disposed, relative to each other, so as to define a trim cavity having a predetermined width, perpendicular to the vertical plane of the trench duct side walls, and a predetermined vertical depth; and a trim piece mounted on each side rail, with each trim piece including:

a center section having a vertical axis, first end and a second end;

a tile separator end that has a vertical axis, that is connected with the first end of the center section, that has a predetermined length, parallel to its vertical axis, less than the predetermined depth of the trim cavity, and thickness less than the predetermined width of the trim cavity;

a cover flange that has first and second opposed, generally parallel horizontal support surfaces, that has a vertical thickness, between its first and second surfaces, substantially equal to the first predetermined distance, that has a longitudinal axis, and that projects horizontally from the center section in one direction such that its longitudinal axis is perpendicular to the vertical axis of the center section; and a floor flange that has a longitudinal axis, that has first and second, opposed, generally parallel horizontal support surfaces, that has a vertical thickness, between its first and second surfaces, substantially equal to the second predetermined distance, and the projects horizontally from the center section in a direction opposite the cover flange such that its longitudinal axis is perpendicular to the vertical axis of the center section;

the trim piece being adapted to the positioned in selectively one of:

a first, carpeted position where the first surface of the cover flange overlies the upper surface of the cover support flange, where a side edge of the trench duct cover overlies the second surface of the cover flange, where the first surface of the floor flange overlies the upper surface of the trim support flange, where the second surface of the floor flange is generally coplanar with the upper surface of the concrete floor, where the tile separator end is disposed within the trim cavity, and where the second end of center section is adjacent to the upper surface of the concrete floor; and a second, tiled position where the second surface of the cover flange overlies the upper surface of the trim support flange, where the side edge of the trench duct cover overlies the first surface of the floor flange, wherein the second surface of the floor flange overlies the upper surface of the cover support flange, where the first surface of the cover flange is generally coplanar with the upper surface of the concrete floor, where the tile separator end projects above the upper surface of the floor a distance substantially equal to the thickness of the tile, and where the second end of the center section is adjacent to the trim cavity.

2. The improvement of claim 1 wherein the first end of the cover support flange is adjacent to the vertical plane of the side wall; wherein the trim cavity is defined between the second end of the cover support flange and the first end of the trim support flange; and wherein the trim support flange is nearer to the upper surface of the concrete floor than the cover support flange.

3. The improvement of claim 2 wherein the floor flange is connected with the center section adjacent to the second end of the center section; and wherein the predetermined length of the tile separator end is substantially equal to the thickness of the tile.

4. The improvement of claim 3 wherein the first predetermined distance is equal to the second predetermined distance.

* * * * *